United States Patent [19]

Okazaki

[11] Patent Number: 4,571,784

[45] Date of Patent: Feb. 25, 1986

[54] SEPARABLE BOTTOM-END-STOP ASSEMBLY FOR SEPARABLE SLIDE FASTENER

[75] Inventor: Fumio Okazaki, Kurobe, Japan

[73] Assignee: Yoshida Kogyo K. K., Tokyo, Japan

[21] Appl. No.: 575,862

[22] Filed: Feb. 1, 1984

[30] Foreign Application Priority Data

Aug. 3, 1983 [JP] Japan ..... 58-120982[U]

[51] Int. Cl.[4] ..... A44B 19/00

[52] U.S. Cl. ..... 24/433; 24/434

[58] Field of Search ..... 24/433, 434

[56] References Cited

U.S. PATENT DOCUMENTS

| | | | |
|---|---|---|---|
| 2,146,691 | 2/1939 | Sundback | 24/433 |
| 3,365,758 | 1/1968 | Hansen | 24/433 |
| 4,112,553 | 9/1978 | Weitzner | 24/433 |
| 4,244,087 | 1/1981 | Akashi | 24/433 |
| 4,377,022 | 3/1983 | Akashi | 24/433 X |
| 4,414,718 | 11/1983 | Kumano | 24/434 X |

FOREIGN PATENT DOCUMENTS

| | | | |
|---|---|---|---|
| 865133 | 1/1953 | Fed. Rep. of Germany | 24/433 |
| 2115383 | 12/1971 | Fed. Rep. of Germany | 24/433 |
| 143854 | 9/1980 | Fed. Rep. of Germany | 24/433 |

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A separable bottom-end-stop assembly of thermoplastic synthetic resin, for a separable slide fastener, comprises a pair of first and second separate pin members, and a socket member for being secured to the first pin member, the socket member having a pair of first and second bores receptive of the first and second pin members, respectively. The first pin member has on its opposite faces a pair of recesses, and the socket member has a pair of opposed projections extending into the first bore. In assembling, the projections of the socket member are received in the respective recesses of the first pin member when the latter is inserted into the socket member's first bore. Because of this projection-and-recess locking, the first pin member can be kept exactly in position relative to the socket member while these two members are joined together by fusing.

6 Claims, 12 Drawing Figures

SEPARABLE BOTTOM-END-STOP ASSEMBLY FOR SEPARABLE SLIDE FASTENER

BACKGROUND OF THE INVENTION

1. Field of the Invention

The present invention relates to a separable bottom-end-stop assembly for a separable slide fastener.

2. Prior Art

There are known various separable slide fasteners in which a separable bottom-end-stop assembly of thermoplastic synthetic resin is mounted on adjacent bottom ends of opposed fastener stringers. The separable bottom-end-stop assembly generally comprises a pair of pin members secured to the inner tape margins at their respective bottom end portions, and a socket member secured to one of the pin members. In some of the known bottom-end-stop assemblies, the socket member is attached to one of the pin members by snap action, and in the others, the socket member is fused with one of the pin members by using an ultrasonic horn, for exmaple.

However, in the former case, adequately firm attachment of the socket member cannot be achieved; yet, increasing the amount of "snap-action" strength causes non-easy insertion of the pin member into a bore of the socket member. The one pin member thus tends to be inclined relative to the socket member to assume an improper posture. Consequently, accurate and reliable assembling of such prior bottom-end-stop components cannot be carried out by a fully-automated assembling machine and must be done by a well-experienced person who operates various separate tools or devices, which is laborious and time-consuming.

In the latter case, although the one pin member can be inserted into the socket member's bore easily, it is difficult to place the one pin member exactly in position relative to the socket member. Therefore, this prior bottom-end-stop assembly also cannot be assembled by a fully-automated machine.

SUMMARY OF THE INVENTION

According to the present invention, a separable bottom-end-stop assembly of thermoplastic synthetic resin, for a separable slide fastener, comprises a pair of first and second separate pin members, and a socket member for being secured to the first pin member, the socket member having a pair of first and second bore receptive of the first and second pin members, respectively. The socket member has on its opposite inner faces a plurality of parallel longitudinal ridges facing the first bore. In assembling, the first pin member slides on the guide ridges without lateral displacement as the first pin member is inserted into the first bore.

It is therefore an object of the invention to provide a separable bottom-end-stop assembly in which the socket member can be attached to one of the pin members easily and accurately with adequate firmness.

Another object of the invention is to provide a separable bottom-end-stop assembly which can be assembled by a fully-automated machine.

Still another object of the invention is to provide a separable bottom-end-stop assembly in which one of the pin members can be inserted into the socket member's bore easily and reliably without lateral displacement.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
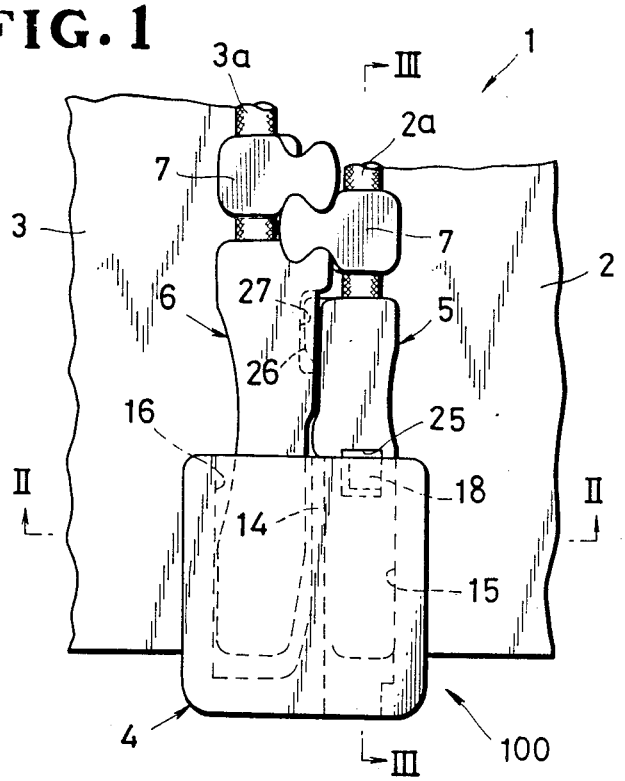
FIG. 1 is a fragmentary plan view of a separable slide fastener having a separable bottom-end-stop assembly embodying the present invention.

FIG. 1 shows a separable slide fastener 1 comprising a pair of fastener stringers each including a stringer tape 2, 3 carrying on and along its inner longitudinal margin 2*a*, 3*a* a row of coupling elements 7 in the form of separate scoops made of thermoplastic synthetic resin. A separable bottom-end-stop assembly 100 is mounted on adjacent bottom ends of the stringers at the respective bottom end portions of the confronting inner tape-margins 2*a*, 3*a*. The bottom end portion is devoid of several coupling elements 7, the number of which is not pertinent here. A slider (not shown) is threaded on the opposed row of coupling elements 7 for movement therealong to close and open the slide fastener 1.

As shown in FIGS. 1–4, the separable bottom-end-stop assembly 100 includes a first separate pin member 5 of thermoplastic synthetic resin mounted on the bottom end portion of one of the inner tape-margins 2*a* by injection-molding, a second separate pin member 6 of thermoplastic synthetic resin mounted on the bottom end portion of the other inner tape-margin 3*a* by injection-molding, and a socket member 4 of thermoplastic synthetic resin secured to the first pin member 5 by fusing in a manner described below.

Figure 2:
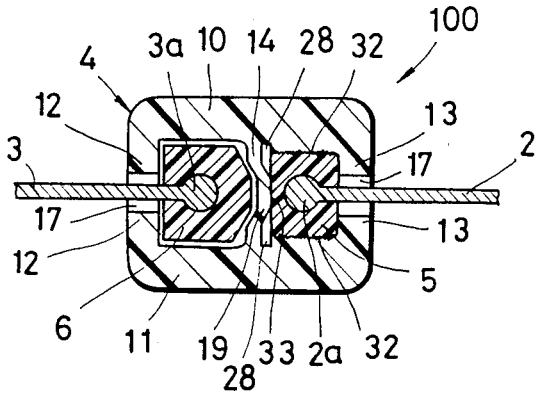
FIG. 2 is a transverse cross-sectional view taken along line II—II of FIG. 1.
Figure 4:
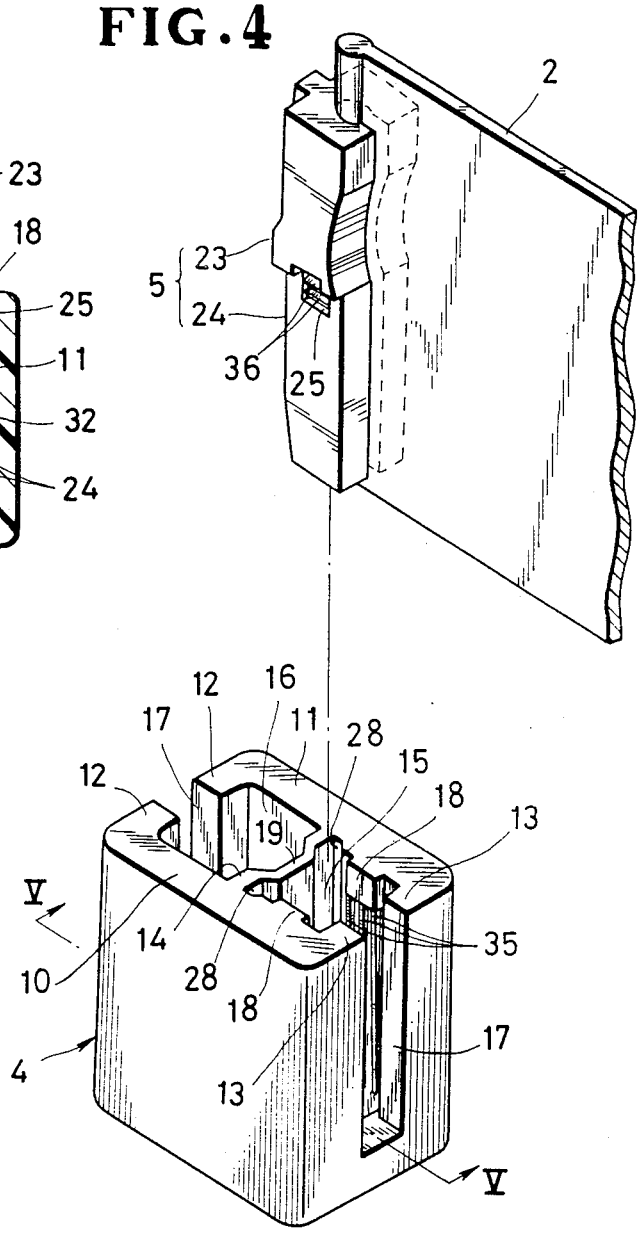
FIG. 4 is an exploded perspective view of the bottom-end-stop assembly of FIG. 1, with one of a pair of pin members omitted.
Figure 5:
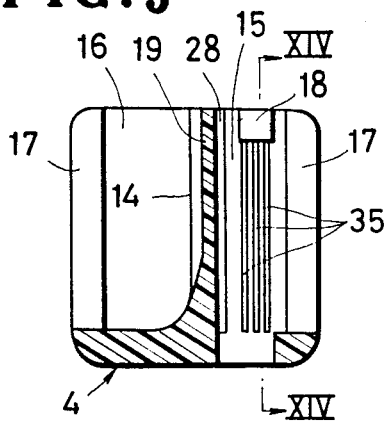
FIG. 5 is a cross-sectional view taken along line V—V of FIG. 4.

As shown in FIG. 4, the socket member 4 has a pair of flanged upper and lower wings 10, 11 joined by a partition wall 14 extending centrally of the wings 10, 11 to define a first longitudinal through-bore 15 and a second longitudinal blind bore, 16 for receiving a portion of the first pin member 5 and a portion of the second pin member 6, respectively. The socket member 4 has a pair of slits 17, 17, each communicating with a respective one of the first and second bore 15, 16, for receiving the respective stringer tapes 2, 3, as shown in FIG. 2.

The partition wall 14 has a central bulge 19 swelling into the first bore 15 for resiliently urging or pressing the first pin member 5 against the flanges 13, 13 of the upper and lower wings 10, 11 when the first pin member 5 is inserted into the first bore 15.

Figure 8A:
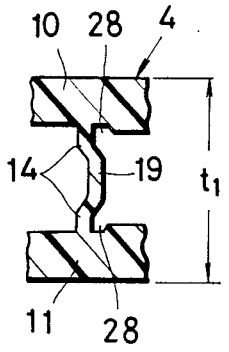
FIGS. 8A, 8B and 8C are fragmentary cross-sectional views of the socket member illustrating the manner in which the socket member is deformed while the pin member is forced into a bore of the socket member.
Figure 8B:
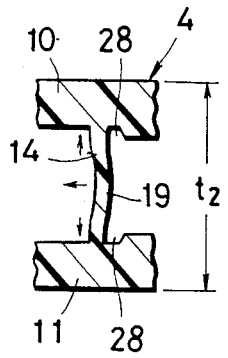
Figure 8C:
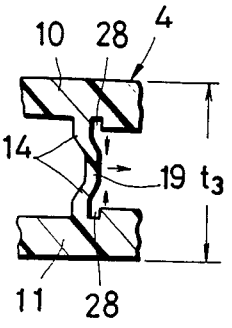
Figure 9:
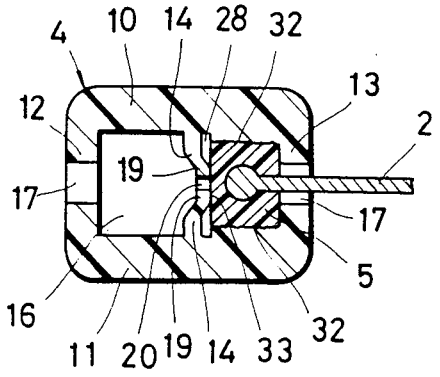
FIG. 9 is a transverse cross-sectional view similar to FIG. 2, showing a modified form of the socket member.

Each of the wings 10, 11 has in its inner face a groove 28 extending along the base of the partition wall 14 and opening into the first bore 15, facilitating the deforming of the partition wall 14 when the first pin member 5 is forced into the first bore 15, as described below in connection with FIGS. 8A, 8B and 8C.

The socket member 4 also has at its top end a pair of opposed projections 18, 18 extending from respective inner faces of the upper and lower wings 10, 11 into the first bore 15, for a purpose described below.

Figure 3:
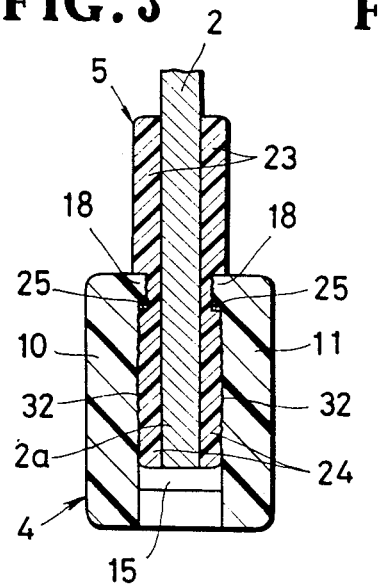
FIG. 3 is a longitudinal cross-sectional view taken along line III—III of FIG. 1.
Figure 7:
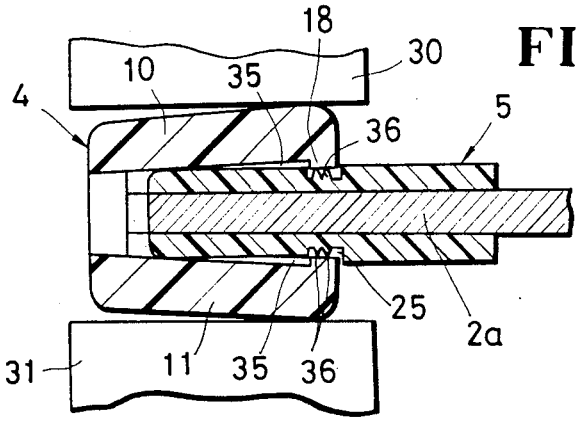
FIG. 7 is a cross-sectional view illustrating the manner in which the socket member is secured to one of the pin members by fusing.

The first pin member 5 includes an upper portion 23 and a lower portion 24 having a thickness slightly smaller than not only the thickness of the upper portion 23, but substantially equal to the distance between the upper and lower wings 10, 11. The lower portion 24 of the first pin member 25 is flat. When the socket member 4 is secured to the first pin member 5, the lower portion 24 of the first pin member 5 is received in the first bore 15. The first pin member 5 also has in opposite faces a pair of recesses 25, 25 for receiving the respective projections 18, 18 of the upper and lower wings 10, 11 when the socket member 4 is secured to the first pin member 5, as shown in FIGS. 1, 3 and 7. Each of the recesses 25 is disposed across to the border between the upper and lower portions 23, 24.

Figure 6:
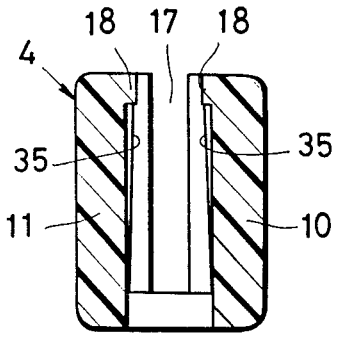
FIG. 6 is a cross-sectional view taken along line VI—VI of FIG. 5.

Each of the upper and lower wings 10, 11 has on its inner face a plurality of parallel longitudinal guide ridges 35 (FIGS. 4–7) facing the first bore 15 for being slidably engageable with a respective one of opposite faces of the first pin member 5 while the latter is inserted into the first bore 15. As shown in FIGS. 6 and 7, each of the guide ridges 35 has a height decreasing progressively toward a bottom end of the socket member 4 for facilitating the inserting of the first pin member into the first bore 15. The maximum height of the guide ridges 35 is slightly smaller than the height of the projections 18. The first pin member 5 also has one or more additional ridges 36 (FIGS. 4, 7 and 10) projecting from a bottom face of each recess 25. The socket member 4 is integrally joined with the first pin member 5 when the upper and lower wings 10, 11 are compressed between an ultrasonic horn 30 and a coacting anvil 31, as shown in FIG. 7, at which time the ridges 35 of the wings 10, 11 are melted and fused with the opposite faces of the first pin member 5. At the same time, the ridges 36 of the first pin member 5 also are melted and fused with the respective projections 18, 18 of the wings 10, 11.

Figure 10:
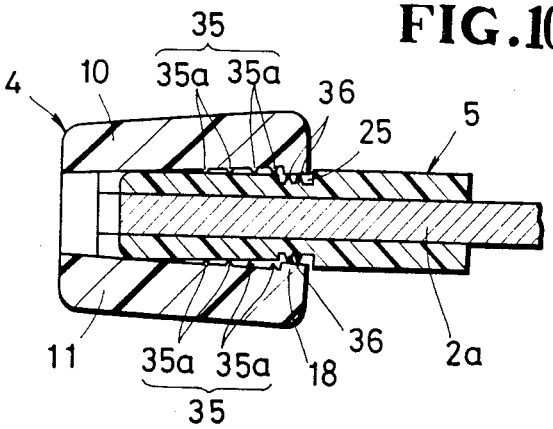
FIG. 10 (appearing with FIGS. 5–7) is a cross-sectional view similar to FIG. 7, showing a modified form of the socket member.

Alternatively, each of the guide ridges 35 may be composed of a plurality of spaced segments 35*a*, as shown in FIG. 10.

The second pin member 6 (FIG. 1) has a recess 27 for receiving a projection 26 of the first pin member 5 when the first and second pin members 5, 6 are placed exactly in position for correct interengaging of the opposed row of coupling elements, 7 of the two stringers.

To attach the socket member 4 to the first pin member 5, the first pin member 5 of FIG. 4 is inserted into the first bore 15 of the socket member 4 (FIGS. 4–6) from the top end thereof. At that time the socket member 4, which has in its free form a thickness $t_1$ (FIG. 8A), is expanded or deformed so as to have an increased thickness $t_2$ (FIG. 8B). Then the socket member 4 recovers as the projections 18, 18 of the upper and lower wings 10, 11 are received in the recesses 25, 25, respectively, of the first pin member 5.

Finally, the upper and lower wings 10, 11 are compressed between the ultrasonic horn 30 and the coacting anvil 31, as shown in FIG. 7, causing the central bulge 19 to resiliently urge or press the first pin member 5 against the flanges 13, 13 of the upper and lower wings 10, 11. As a result, the socket member 4 is integrally joined with the first pin member 5 by fusing at 32, 33 (FIGS. 2 and 3), at which time the ridges 35 of the wings 10, 11 are melted and fused with the opposite faces of the first pin member 5. At the same time, the ridges 36 of the first pin member 5 also are melted and fused with the respective projections 18, 18 of the wings 10 11. The resilient socket member 4 has a thickness $t_3$ (FIG. 8C) slightly smaller than the thickness $t_1$.

With this arrangement, the socket member 4 can be attached to the first pin member 5 easily and accurately with adequate firmness, partly because the first pin member 5 is resiliently pressed by the central bulge 19 of the partition wall 14 against the flanges 13, 13 of the upper and lower wings 10, 11, and partly because the projections 18, 18 of the wings 10, 11 are received in the respective recesses 25, 25 of the first pin member 5.

Further, the first pin member 5 slides on the parallel sloping guide ridges 35 of the socket member without lateral displacement when the first pin member 5 is inserted into the first bore 15 of the socket member 4, thus causing easy and correct positioning of the first pin member 5 relative to the socket member 4.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A separable bottom-end-stop assembly for a separable slide fastener including a pair of fastener stringers, each including a stringer tape carrying on its inner longitudinal margin a row of coupling elements, the inner tape-margin having a bottom end portion devoid of coupling elements, said assembly comprising:

(a) a first pin member of thermoplastic synthetic resin adapted to be secured to the bottom end portion of the inner tape-margin of one stringer, said first pin member having in opposite faces a pair of recesses;

(b) a second pin member of thermoplastic synthetic resin adapted to be secured to the bottom end portion of the inner tape-margin of the other stringer;

(c) a socket member of thermoplastic synthetic resin adapted to be united with said first pin member and having a pair of flanged wings joined by a partition wall to define between said wings a first and a second bore for receiving a portion of said first pin member and a portion of said second pin member, respectively, said partition wall having a central bulge swelling into said first bore for resiliently pressing said first pin member, when the latter is inserted into said first bore, against said wings' flanges that partly define said first bore, each of said wings having on its inner face a projection adapted to be received in a respective one of said recesses in said first pin member when said socket member is secured to said first pin member; and (d) each of said wings having on its inner face a plurality of parallel longitudinal guide ridges facing said first bore for being slidably engageable with a respective one of the opposite faces of said first pin member while the latter is inserted into said first bore, said guide ridges being adapted to be melted and fused with said first pin member when said socket member is secured to said first pin member by applying heat and pressure.

2. A separable botton-end-stop assembly according to claim 1, each of said guide ridges having a height decreasing progressively toward a bottom end of said socket member.

3. A separable botton-end-stop assembly according to claim 2, each of said guide ridges including a plurality of spaced segments.

4. A separable botton-end-stop assembly according to claim 1, said first pin member having at least one additional ridge projecting from a bottom face of each said recess, said additional ridge in each said recess being adapted to be fused with a respective one of said projections of said socket member by melting when said socket member is secured to said first pin member by said applying of heat and pressure.

5. A separable bottom-end-stop assembly according to claim 2, the maximum height of said guide ridges being slightly smaller than the height of said projections.

6. A separable bottom-end-stop assembly according to claim 4, said additional ridge having a height slightly smaller than the depth of said recess.

* * * * *